US005497530A

United States Patent [19]

Kamm et al.

[11] Patent Number: 5,497,530

[45] Date of Patent: Mar. 12, 1996

[54] WIPER DEVICE FOR HARD SURFACES, IN PARTICULAR A WINDOW WIPER

[75] Inventors: Roland Kamm, Winnenden; Eberhard Veit, Göppingen; Josef Schneider; Antonio De Filippo, both of Backnang, all of Germany; Donald W. Murray, Saginaw, Tex.; Michael C. Story; Carl S. Lammons, both of Arlington, Tex.

[73] Assignee: Alfred Karcher GmbH & Co., Winnenden, Germany

[21] Appl. No.: 185,867

[22] PCT Filed: Jul. 23, 1992

[86] PCT No.: PCT/EP92/01688

§ 371 Date: Mar. 25, 1994

§ 102(e) Date: Mar. 25, 1994

[87] PCT Pub. No.: WO93/02611

PCT Pub. Date: Feb. 18, 1993

[30] Foreign Application Priority Data

Aug. 3, 1991 [DE] Germany ..... 41 25 866.5

[51] Int. Cl.[6] ..... A47L 7/00; A47L 9/02; A47L 5/00; A47L 1/08

[52] U.S. Cl. ..... 15/321; 15/144.4; 15/322; 15/339; 15/365; 15/367; 15/393; 15/401; 15/414; 401/25; 401/13; 401/139; 401/140; 401/266

[58] Field of Search ..... 15/114, 118, 121, 15/144.4, 321, 322, 339, 365, 393, 401, 410, 414, 418, 367; 401/13, 25, 27, 48, 130, 138, 139, 140, 266

[56] References Cited

U.S. PATENT DOCUMENTS

| | | | |
|---|---|---|---|
| 1,140,992 | 5/1915 | Martin | 15/414 |
| 2,101,222 | 12/1937 | McCracken | 15/414 |
| 2,623,234 | 12/1952 | Brown | 15/144.4 |
| 2,867,835 | 1/1959 | Brown et al. . | |
| 2,905,960 | 9/1959 | Ward . | |
| 3,254,360 | 6/1966 | Hageman . | |
| 3,608,126 | 9/1971 | Tacoma | 15/414 |
| 4,195,383 | 4/1980 | Leinfelt | 15/339 |
| 4,266,317 | 5/1981 | Duda | 15/322 |
| 4,275,478 | 6/1981 | Kohlenberger | 15/401 |
| 4,475,265 | 10/1984 | Berfield | 15/401 |
| 4,557,013 | 12/1985 | Belmont . | |
| 4,696,074 | 9/1987 | Cavalli | 15/322 |
| 4,776,716 | 10/1988 | Huang . | |
| 4,817,233 | 4/1989 | Waldhauser | 15/322 |
| 4,833,752 | 5/1989 | Merrick | 15/322 |
| 5,001,806 | 3/1991 | Gurstein | 15/414 |
| 5,184,372 | 2/1993 | Mache . | |
| 5,280,666 | 1/1994 | Wood | 15/401 |

FOREIGN PATENT DOCUMENTS

| | | | |
|---|---|---|---|
| 0176696 | 4/1986 | European Pat. Off. | 15/322 |
| 0381783 | 8/1990 | European Pat. Off. | 15/121 |
| 2092707 | 1/1972 | France . | |
| 2572920 | 5/1986 | France . | |
| 2713995 | 10/1977 | Germany . | |
| 8019169 | 2/1981 | Germany . | |
| 3447774 | 7/1985 | Germany . | |
| 9016463 | 4/1991 | Germany . | |
| 583102 | 12/1946 | United Kingdom | 15/401 |

*Primary Examiner*—David Scherbel
*Assistant Examiner*—Randall E. Chin
*Attorney, Agent, or Firm*—Barry R. Lipsitz

[57] ABSTRACT

In order to reduce the energy consumption of the suction unit, on the one hand, and to improve the cleaning effect, on the other hand, of a wiper device for hard surfaces, in particular a window wiper, comprising a slit-shaped suction nozzle, on which a flexible wiper lip is arranged, which protrudes forwardly beyond the suction nozzle, it is suggested that the wiper lip be held on a wall of the suction nozzle and drawn against the opposite wall of the suction nozzle under the influence of a suction stream in the suction nozzle and thereby close the suction nozzle.

37 Claims, 3 Drawing Sheets

Figures 1, 2:
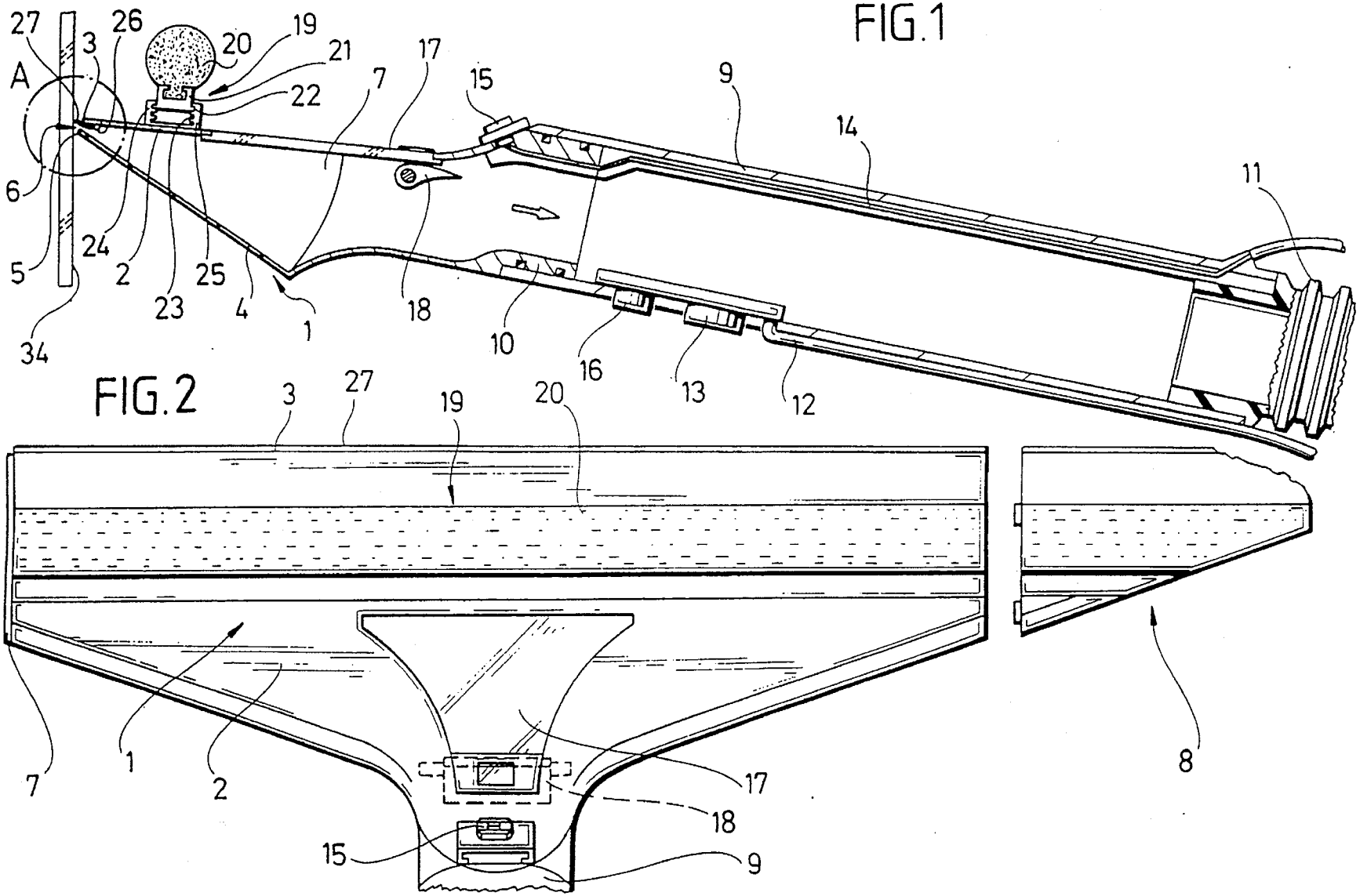

11
14
9
12
13
16
10
15
17
18
7
21
19
22
20
25
23
2
24
26
3
27
A
6
5
34
1
4
8
20
19
27
3
17
18
9
15
2
1
7

WIPER DEVICE FOR HARD SURFACES, IN PARTICULAR A WINDOW WIPER

The invention relates to a wiper device for hard surfaces, in particular a window wiper, comprising a slit-shaped suction nozzle, a flexible wiper lip being arranged on the nozzle and protruding forwardly beyond the suction nozzle.

A window wiper of this type is known, for example, from German Utility Model No. 80 19 169. In this case, a foamed rubber-type wiper pad is located in a slit-like suction nozzle and, in addition, a wiper lip is arranged next to the wiper pad and independently of the slit nozzle. The suction effect in this known device is hindered by the foamed rubber-type wiper pad in the suction nozzle and so a suction unit having a particularly high power capacity is necessary to maintain the required suction stream.

The object of the invention is to improve a wiper device of the generic type such that the required suction capacity of the suction unit is reduced while, on the other hand, an improved wiping and cleaning action can be achieved. This object is accomplished in accordance with the invention, in a wiper device for hard surfaces of the type described at the outset, in that the wiper lip is held on a wall of the suction nozzle and is drawn against the opposite wall of the suction nozzle under the influence of a suction stream in the suction nozzle and thereby closes the suction nozzle.

In the new wiper device the suction nozzle is, therefore, normally open so that the suction stream can pass unhindered into the suction nozzle. As long as the wiper device rests on the window surface to be cleaned, the wiper lip is bent back such that the suction opening is opened. If, on the other hand, the wiper device is removed from the surface to be cleaned, the suction stream now sucks the free wiper lip onto the opposite wall and thereby closes the suction opening. This has, on the one hand, the advantage that when the device is not in use and the suction opening therefore closed the required suction capacity of a suction unit attached to the wiper device is reduced and, on the other hand, liquid is reliably prevented from reaching the outside from the interior of the wiper device, even when the user holds the wiper device with the suction nozzle facing downwards.

It is particularly advantageous for the wiper lip to project through the suction nozzle, whereby it is preferably arranged in its undeformed state between the two walls defining the suction nozzle. This means that the wiper lip can be bent up in one direction out of its undeformed rest position when it abuts on the surface to be cleaned whereas it is bent in the other direction, in which it closes the suction opening, when the wiper device is not in use and the suction unit is switched on. In a preferred embodiment, the wall mounting the wiper lip bears a support surface which extends towards the front edge of the wiper lip and on which the wiper lip abuts when it is deformed towards a complete opening of the suction nozzle. This means that the movement of the wiper lip is limited in opening position. The wiper lip, which rests on the surface to be cleaned with a front edge when it is drawn down this surface, is supported on the support surface in this way with its rear side so that the user can exactly meter the force with which the front edge of the wiper lip rests on the surface to be cleaned even though the wiper lip consists of a flexible material.

In this respect, it is advantageous for the support surface to extend almost as far as the front edge of the wiper lip.

The support surface is preferably curved convexly towards the front edge of the wiper lip so that the wiper lip is not bent over sharply at any point. This promotes the flow properties of the suction stream in the region of the suction opening; in this way turbulences in this region are avoided.

The front edge of the support surface and the front edge of the opposite wall are preferably arranged approximately opposite one another. They therefore form the slit-like suction opening between them, whereby the suction opening is constricted at one wall due to the wiper lip resting on the support surface. This construction makes it possible to exactly define the width of the gap between the front edge of the opposite wall and the surface to be cleaned since the distance of the wiper device as a whole from the surface to be cleaned is determined by the front edge of the support surface and the wiper lip. In this way, the suction properties in the region of the suction nozzle may be optimalized.

It is favorable for the walls adjoining the suction nozzle in the suction direction to diverge in the suction direction. This results in a particularly high suction velocity in the region of the suction nozzle.

In addition, the wiper device can bear next to the suction nozzle a wiper pad extending parallel thereto, with which a cleaning liquid applied to the surface to be cleaned can, if necessary, be distributed under pressure and with which a mechanical precleaning of the surface to be cleaned takes place.

It is particularly advantageous for the wiper pad to be arranged on the same wall as the wiper lip. In this way, the wiper pad is located on the side remote from the surface to be cleaned when this surface is wiped and does not hinder the wiping procedure. In order to use the wiper pad, the wiper device is simply turned around so that the wiper pad then points in the direction towards the surface to be cleaned.

It is advantageous when the wiper pad is adapted to be secured in position in a holder arranged on the wall at various distances from the wall. In this way it is possible to replace the wiper pad, for example when the use of wiper pads having different hardnesses is desired. On the other hand, ergonomic aspects may be taken into consideration in an optimum manner when the wiper pad is arranged at varying distances from the wall of the wiper device. A particularly simple exchangeability results when the wiper pad is insertable laterally into the holder.

In addition, it is favorable for the wiper device to have a spray nozzle for applying a cleaning liquid to the surface to be cleaned, whereby the spray nozzle is preferably arranged on the same side as the wiper pad. It is then possible to add cleaning liquid as desired in a metered manner during cleaning of the surface with the wiper pad.

The spray nozzle can be releasably held in position in a slide-in holder and so as to be sealed relative to the wiper device so that it can be interchanged simply and at any time by insertion or withdrawal. This means that nozzles having different spray characteristics can be used, for example spot spraying nozzles for a powerful precleaning and flat spraying nozzles for an even application of the cleaning liquid to a larger area.

An actuating knob for the spray nozzle can be arranged on the side of the wiper device opposite the spray nozzle, whereby it is favorable for a switch element for switching on and off a suction unit generating the suction stream to be arranged next to the actuating knob.

In order to be able to monitor the functioning of the wiper device and in order to be able to ascertain the degree of soiling of the liquid sucked off, the wiper device may be transparent at least in certain regions in the part lying downstream of the suction nozzle. In a preferred embodiment, an indicator element which is visible from the outside and movable into various positions as a function of the force of the suction stream is arranged in the interior of the wiper device. When a suction stream is absent, this may be detected quite easily due to the different position of the indicator element in comparison with an operative suction stream.

The wiper device can be widenable in the region of the suction nozzle by an extension element, in which the suction nozzle continues. In this respect, it is favorable for the wiper device to bear a removable closure plate at its lateral end faces, the extension element being attachable in its stead.

A telescopically extendable suction pipe may adjoin the suction nozzle. This pipe can, for example, be lockable in the extended position so that it is drawn automatically into the shortened position when the locked position is released and the suction opening closed by the wiper lip.

Figure 3:
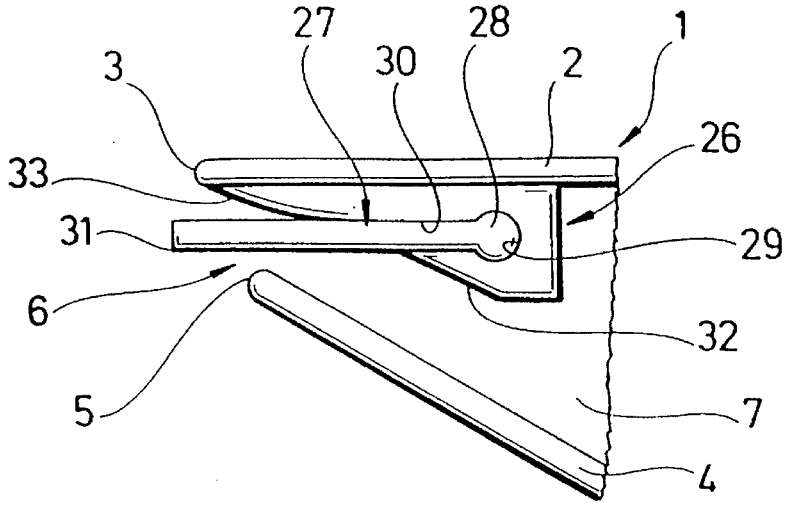
Figure 4:
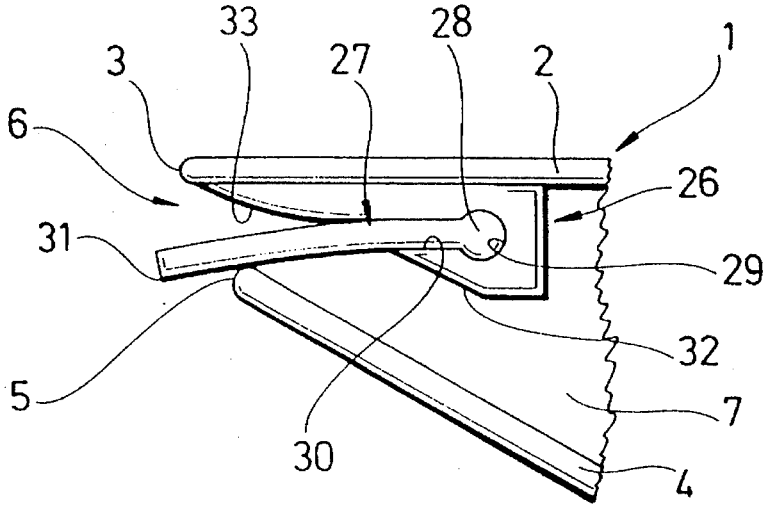
Figure 5:
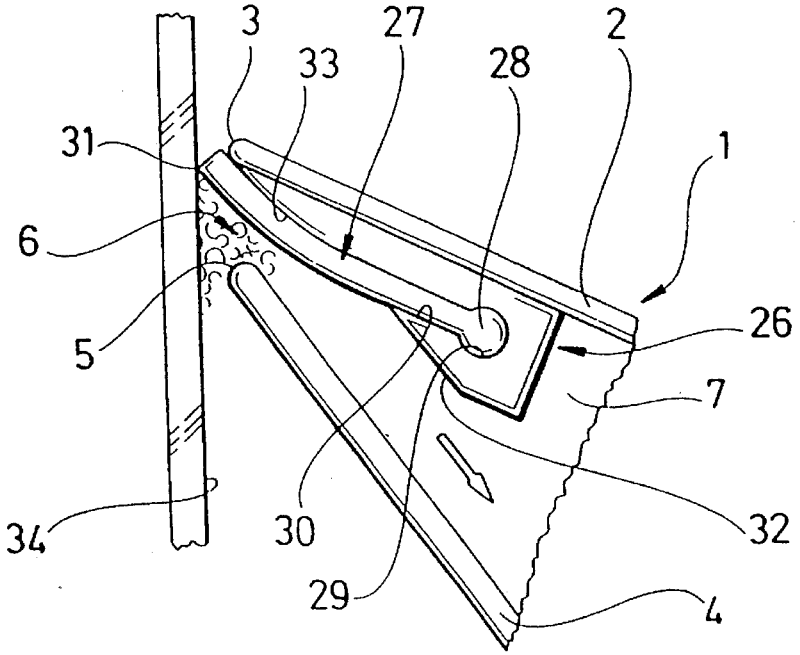
Figure 6:
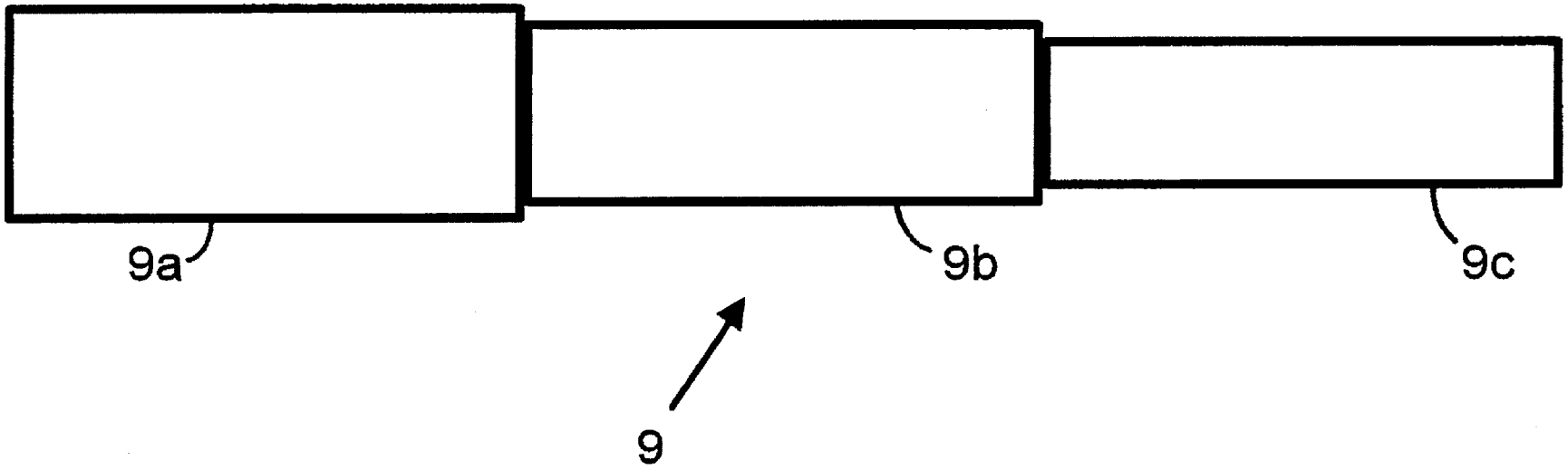

The following description of preferred embodiments of the invention serves to explain the invention in greater detail in conjunction with the drawings. In the drawings:

FIG. 1: shows a longitudinal sectional view of a wiper device resting on a windowpane;

FIG. 2: is a plan view onto the front part of the wiper device of FIG. 1;

FIG. 3: shows an enlarged longitudinal sectional view of the wiper device in the region of circle A in FIG. 1, with the suction stream switched off;

FIG. 4: is a view similar to FIG. 3 with the suction stream switched on and the wiper device not resting against a surface to be cleaned FIG. 5: is a view similar to FIG. 4 with the wiper device resting against a surface to be cleaned; and FIG. 6: is a view of an alternate, telescoping embodiment of the suction pipe.

The wiper device illustrated in the drawings is primarily intended for the cleaning of windowpanes but is also suitable for cleaning other hard surfaces.

The wiper device comprises a suction head 1 with a plane upper wall 2 and a lower plane wall 4, which diverges at an acute angle from the front edge 3 of the upper wall 2 and the front edge 5 of which forms a slit-like suction nozzle 6 with the front edge 3 of the upper wall 2. At its lateral ends, the suction head 1 which is limited by the upper and the lower wall 2 and 4, respectively, is limited by lateral wall portions 7 which are releasably attached to the walls 2 and 4, for example by elastic snap-in engagement. In this way, the wall portions 7 can be removed and in their stead lateral extension elements 8 can be sealingly connected with the walls 2 and 4. These extension elements are a lateral continuation of the suction head 1 and in this way widen the suction head 1 and, in particular, the suction nozzle 6 (FIG. 2). The width of the suction nozzle 6 can be varied in this manner, either by not using any extension element or by adding extension elements to only one side or to both sides.

The suction head 1 limited by the walls 2 and 4 merges on the side opposite the suction nozzle 6 into a suction pipe 9 which is sealingly mounted onto a connection piece 10 at the end of the suction head 1 opposite the suction nozzle 6. The suction pipe 9, which is designed as a rigid piece of pipe in the illustrated embodiment, can also comprise a telescoping pipe consisting of several pipe sections 9*a*, 9*b* and 9*c*, as illustrated in FIG. 6.

The suction pipe 9 is connected to a flexible suction tube 11 which leads to a suction unit in a manner not apparent from the drawing. This suction unit is preferably operated via its own battery but it can also be supplied via an electric supply cable, for example, from the battery of a motor vehicle. In order to switch the suction unit on and off, a control line 12 is provided which leads along the suction tube 11 and the suction pipe 9 to a switch 13 in the suction pipe 9. This switch 13 is preferably designed as a push button so that the suction unit operates while pressure is exerted on the switch 13 but switches off when the switch is released.

Furthermore, a pump may be located next to the suction unit to transport a cleaning liquid from a supply vessel via a supply line 14 to a spray nozzle 15 which is located in the upper wall 2 in the immediate vicinity of the connection piece 10. This spray nozzle can be securely connected to the upper wall 2; in a preferred embodiment it is insertably held in a corresponding holder, whereby a seal is provided between the spray nozzle and the upper wall 2 via sealing means not illustrated in the drawing. In such a construction, the spray nozzle can be interchanged in a simple manner.

The pump can be switched on and off via an additional switch 16 which is arranged on the suction pipe 9 next to the switch 13. This switch 16 is also preferably designed as a push button.

The control line 12 and the supply line 14 may extend in the interior of the suction tube 11 but provision may be made for them to exit from the suction pipe at the transition from the suction pipe 9 to the suction tube 11 so that the suction pipe is freely rotatable in relation to the suction tube.

Apart from the supply vessel, a collecting vessel is also associated with the suction unit and liquid sucked through the suction tube 11 is collected therein. A particularly favorable design results when the supply vessel for the cleaning liquid and the collecting vessel for the soiled liquid are located in a common container which is divided into two corresponding chambers by a flexible intermediate wall. This means that the entire container is available at the beginning of the cleaning process for the cleaning liquid, after termination of the cleaning process for the dirty, collected liquid.

A central region 17 of the upper wall is designed to be transparent and therefore forms a window, through which the interior of the suction head 1 can be viewed and it can be ascertained whether liquid is being sucked through and, if necessary, the degree of soiling of such liquid. Moreover, it is possible to see an indicator element 18, which is pivotally mounted in the interior of the suction head 1, through this transparent region 17. This element has a wing-type profile and is therefore pivoted by the suction stream into a horizontal position, as is apparent from FIG. 1. If the suction stream is lacking, the indicator element 18 will, on the other hand, hang downwards. These different positions can be detected from the outside, for example, due to the fact that in the horizontal case a colored surface of the indicator element 18 is to be seen directly beneath the transparent upper wall 2 but, on the other hand, when the suction stream is absent this surface is not to be seen. This results in an indicator element which indicates the presence of a suction stream and, if necessary, the force thereof, as well.

A holder 19 for an elongated wiper pad 20 is located on the upper wall 2, extending parallel to the front edge 3 and at a slight distance therefrom. This wiper pad can, for example, have a circular cross section and consist of foamed rubber which is secured in a bar 21 U-shaped in cross section. This bar 21 has laterally protruding projections 22 for insertion into opposite grooves 23 of two parallel walls 24 and 25 of the holder 19 (FIG. 1). A plurality of grooves 23 of this type are provided one above the other in the walls 24 and 25 so that the bar 21 can be inserted at varying distances in relation to the upper wall 2. In this way, the wiper pad 20 can also be arranged at varying distances in relation to the upper wall 2 of the suction head 1. The bar with the wiper pad can be removed quite easily by lateral displacement so that the wiper pad can be exchanged as desired. A retaining bar 26 for a strip-like wiper lip 27, which consists of a flexible material, for example of rubber, is arranged on the inner side of the upper wall 2 in the region of the suction nozzle 6. This wiper lip 27 is inserted laterally into a corresponding recess 29 of the retaining bar 26 with a rear edge 28 thickened in the form of a bead, whereby the wiper lip 27 passes through a slot 30 which exits from the recess 29 essentially parallel to the upper wall 2. In this way, the wiper lip 27 is secured against any displacement in the longitudinal direction.

The slot 30 is arranged such that the undeformed wiper lip 27 exiting therefrom and extending parallel to the upper wall 2 is arranged approximately between this wall and the front edge 5 of the lower wall 4 (FIG. 3). In this respect, the wiper lip 27 protrudes slightly beyond the front edge 3 of the upper wall 2 whereas the front edge 5 of the lower wall 4 is set back somewhat in relation thereto. The wiper lip 27 terminates at its free end with a rectangular cross section, i.e. a sharp front edge 31 results on the underside of the wiper lip.

The underside 32 of the retaining bar 26 is designed to be parallel to the lower wall 4 in the part located downstream of the slot 30. Underside 32 provides a support surface 33 between the slot 30, on the one hand, and the front edge 3 of the upper wall 2, on the other hand. Support surface 33 is slightly curved convexly. The underside 32 is uniformly profiled along the entire length of the holder bar 26.

During operation, the wiper device described is used first of all to spray the surface to be cleaned with a cleaning liquid. For this purpose, the spray nozzle 15 is directed onto the surface to be cleaned, and by actuating the switch 16 the supply of cleaning liquid is switched on. Cleaning chemicals can be added to the cleaning liquid.

After the cleaning liquid has been applied, the surface to be cleaned is cleaned with the aid of the wiper pad 20, whereby stubborn dirt can also be mechanically loosened by applying a corresponding pressure.

In a next operation step, the wiper device is turned over so that the wiper pad 20 points upwards in the manner apparent from FIG. 1. The wiper device is applied to the surface 34 to be cleaned with the wiper lip 27; at the same time the suction unit is switched on by actuating the switch 13, i.e. a suction stream is generated in the suction head 1, due to which surrounding air is sucked in via the suction nozzle 6.

Before the wiper lip 27 is applied to the surface 34 to be cleaned, the suction nozzle 6 is still closed and an opening does not result until the wiper lip 27 rests against the surface 34 to be cleaned and is bent upwards, i.e. rests against the support surface 33, due to movement of the entire suction head 1 downwards (FIG. 5). In this position, which is caused by the downwardly directed wiping action of the suction head 1, the cleaning liquid is sucked into the suction head 1 from the surface 34 through the suction opening 6 which is then open; at the same time the sharp front edge 31 of the wiper lip 27 slides along the surface 34 and wipes cleaning liquid quantitatively off the surface 34. Following a single wiping stroke the surface is completely free from cleaning liquid. Once the wiper device has been removed from the surface 34, the wiper lip 27 is sucked against the front edge 5 of the lower wall 4 (FIG. 4) due to the action of the suction stream so that the suction nozzle 6 is closed.

On the one hand, this means that the power required by the electromotor driving the suction unit is reduced, i.e. motive energy is saved; on the other hand, it is ensured that even when the wiper device is held such that the nozzle points downwardly, no sucked-in cleaning liquid can run out of it.

A quite particular advantage of this automatically occurring closure of the suction opening is to be seen in the fact that the suction nozzle 6 is opened only in that section in which the wiper lip 27 abuts against the support surface 33 when the wiper lip is applied to the surface 34. When the surface 34 to be cleaned is uneven, only those portions of the wiper lip 27 that traverse raised areas of the surface will bend, and the suction nozzle 6 will be opened only in those portions to provide an effective wiping action. For those portions of the wiper lip 27 that do not abut on the surface 34, and therefore do not generate any wiping action, the suction nozzle 6 remains closed so that no undesired bypass results at these points. The sucking action is therefore concentrated on those regions in which cleaning liquid is effectively wiped off.

An additional advantage of the arrangement described is to be seen in the fact that the support surface 33 supports the wiper lip 27 essentially over its entire length, i.e., in particular, in a region which is located opposite the front edge 31, as well. This means that it is possible to press this front edge against the surface 34 with an exactly metered pressure, despite the flexible design of the wiper lip 27, and therefore to meter the wiping off action.

We claim:

1. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle;

a wiper pad extending from one of said first and second sides of said wiper device adjacent to and extending parallel to said suction nozzles, wherein said wiper pad is located to be entirely out of contact with a suction stream drawn through said suction nozzle; and a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad.

2. A wiper device as defined in claim 1, wherein the wiper lip projects through the suction nozzle.

3. A wiper device as defined in claim 2, wherein the wiper lip is arranged in its undeformed state between said first and opposite walls defining the suction nozzle.

4. A wiper device as defined in claim 1, wherein said wiper lip has a front edge, and the first wall bears a support surface extending towards said front edge of the wiper lip, the wiper lip abutting said support surface when it is deformed towards said first wall to completely open the suction nozzle.

5. A wiper device as defined in claim 4, wherein the support surface extends almost as far as the front edge of the wiper lip.

6. A wiper device as defined in claim 4, wherein the support surface is curved convexly towards the front edge of the wiper lip.

7. A wiper device as defined in claim 4, wherein said support surface and opposite wall each have front edges, the front edge of the support surface and the front edge of said opposite wall being arranged approximately opposite one another.

8. A wiper device as defined in claim 1, wherein said first and opposite walls diverge away from said suction nozzle.

9. A wiper device as defined in claim 1, wherein the wiper pad is arranged on the same wall as the wiper lip.

10. A wiper device as defined in claim 1, wherein said first wall comprises a holder for said wiper pad, and the wiper pad is adapted to be secured in position in said holder at various distances from the first wall.

11. A wiper device as defined in claim 10, wherein said holder has an end for receiving said wiper pad, the wiper pad being insertable into said holder via said end.

12. A wiper device as defined in claim 1, further comprising a slide-in holder for releasably securing the spray nozzle, said slide-in holder sealingly engaging the wiper device.

13. A wiper device as defined in claim 1, wherein an actuating knob for the spray nozzle is arranged on the side of the wiper device opposite the spray nozzle.

14. A wiper device as defined in claim 13 further comprising a suction unit for generating a suction stream, wherein a switch element is arranged next to the actuating knob for switching said suction unit on and off.

15. A wiper device as defined in claim 1, wherein the device is transparent at least in certain regions downstream of the suction nozzle.

16. A wiper device as defined in claim 1, further comprising an indicator element arranged in the interior of said suction nozzle, said indicator element being visible from the outside of said device and movable into various positions as a function of the force of a suction stream being drawn through the suction nozzle.

17. A wiper device as defined in claim 1, further comprising an extension element for widening the suction nozzle.

18. A wiper device as defined in claim 17, said wiper device having a lateral end face and further comprising a removable closure plate at said lateral end face, the removal of said closure plate enabling the attachment of said extension element.

19. A wiper device as defined in claim 1 further comprising a telescopically extendable suction pipe adjoining the suction nozzle.

20. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle such that a suction stream drawn through said suction nozzle will deflect said wiper lip to close said nozzle, said wiper lip having a front edge and said first wall bearing a support surface extending towards said front edge and being curved convexly towards the front edge of the wiper lip, with said wiper lip abutting said support surface when it is deformed towards said first wall to completely open the suction nozzle;

a wiper pad extending from one of said first and second sides of said wiper device adjacent to and extending parallel to said suction nozzle; and a spray nozzle for applying a cleaning liquid to a surface to be cleaned, said spray nozzle being mounted on the same side of said wiper device as said wiper pad.

21. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle such that a suction stream drawn through said suction nozzle will deflect said wiper lip to close said nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad; and a slide-in holder for releasably securing said spray nozzle, said slide-in holder sealingly engaging the wiper device.

22. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle such that a suction stream drawn through said suction nozzle will deflect said wiper lip to close said nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad; and an actuating knob for said spray nozzle, said actuating knob being arranged on the side of said wiper device opposite the spray nozzle.

23. A wiper device as defined in claim 22, further comprising a suction unit for generating said suction stream, wherein a switch element for switching said suction unit on and off is arranged next to said actuating knob.

24. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle such that a suction stream drawn through said suction nozzle will deflect said wiper lip to close said nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad;

wherein said wiper device is transparent at least in certain regions downstream of said suction nozzle.

25. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle such that a suction stream drawn through said suction nozzle will deflect said wiper lip to close said nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad; and an indicator element arranged in the interior of said suction nozzle, said indicator element being visible from the outside of said device and movable into various positions as a function of the force of said suction stream.

26. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle such that a suction stream drawn through said suction nozzle will deflect said wiper lip to close said nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad; and an extension element for widening said suction nozzle.

27. A wiper device as defined in claim 26, said wiper device having a lateral end face and further comprising a removable closure plate at said lateral end face, the removal of said closure plate enabling the attachment of said extension element.

28. A wiper device for a hard surface comprising:

a slit-shaped suction nozzle having a first wall on a first side of the wiper device and an opposite wall on a second side of the wiper device;

a flexible wiper lip arranged On one of said walls and protruding beyond said suction nozzle such that a suction stream drawn through said suction nozzle will deflect said wiper lip to close said nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad; and a telescopically extendable suction pipe adjoining said suction nozzle.

29. A wiper device for a hard surface comprising:

a slit-shaped suction nozzle opening of said having a first wall on a first side of the wiper device and an opposite wall on a second side of the wiper device;

a flexible wiper lip arranged on one of said walls and protruding beyond said suction nozzle, said wiper lip projecting through said suction nozzle;

a wiper pad extending from one of said first and second sides of said wiper device adjacent to and extending parallel to said suction nozzle; and a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad.

30. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle;

a wiper pad extending from one of said first and second sides of said wiper device adjacent to and extending parallel to said suction nozzle; and a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad;

wherein said first wall bears a support surface extending towards a front edge of the wiper lip, the wiper lip abutting said support surface when it is deformed towards said first wall to completely open the suction nozzle, said support surface being curved convexly towards the front edge of the wiper lip.

31. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle;

a wiper pad extending from one of said first and second sides of said wiper device adjacent to and extending parallel to said suction nozzle; and a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad;

wherein said first and opposite walls diverge away from said suction nozzle.

32. A wiper device for a hard surface comprising:

a slit-shaped suction nozzle having a first wall on a first side of the wiper device and an opposite wall on a second side of the wiper device;, a flexible wiper lip arranged on one of said walls and protruding beyond said suction nozzle;

a wiper pad extending from one of said first and second sides of said wiper device adjacent to and extending parallel to said suction nozzle; and a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad;

wherein the wiper pad is arranged on the same wall as the wiper lip.

33. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle;

a wiper pad extending from one of said first and second sides of said wiper device adjacent to and extending parallel to said suction nozzle; and a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad;

wherein the wiper pad is adapted to be secured in position in a holder arranged on the first wall at various distances from the first wall.

34. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle;

a wiper pad extending from one of said first and second sides of said wiper device adjacent to and extending parallel to said suction nozzle; and a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad;

wherein the device is transparent an least in certain regions downstream of the suction nozzle.

35. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad; and an indicator element arranged in the interior of said wiper device, said indicator element being visible from the outside of said device and movable into various positions as a function of the force of a suction stream.

36. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad; and an extension element for widening the suction nozzle.

37. A wiper device for a hard surface comprising:

a slit-shaped suction nozzle having a first wall on a first side of the wiper device and an opposite wall on a second side of the wiper device;

a flexible wiper lip arranged on one of said walls and protruding beyond said suction nozzle;

a wiper pad extending from one of said first and second sides of said wiper device adjacent to and extending parallel to said suction nozzle;

a spray nozzle for applying a cleaning liquid to a surface to be cleaned, said spray nozzle being mounted on the same side of said wiper device as said wiper pad but separate from said wiper pad to enable said cleaning liquid to be applied from the spray nozzle to said surface to be cleaned independently of said wiper pad; and a telescopically extendable suction pipe adjoining the suction nozzle.

* * * * *